United States Patent [19]

Meyrand

[11] Patent Number: 4,639,634

[45] Date of Patent: Jan. 27, 1987

[54] CYCLOTRON WITH FOCUSSING-DEFOCUSSING SYSTEM

[75] Inventor: Gabriel Meyrand, Elancourt Marepas, France

[73] Assignee: C.G.R. Mev, Duc, France

[21] Appl. No.: 597,595

[22] Filed: Apr. 6, 1984

[30] Foreign Application Priority Data

Apr. 12, 1983 [FR] France ..... 83 05939

[51] Int. Cl.[4] ..... H05H 13/00

[52] U.S. Cl. ..... 313/62; 328/234

[58] Field of Search ..... 313/62, 361.1; 328/228, 328/234

[56] References Cited

U.S. PATENT DOCUMENTS

| | | | |
|---|---|---|---|
| 3,175,131 | 3/1965 | Burleigh et al. | 313/62 X |
| 3,789,335 | 1/1974 | Delphin et al. | 313/62 X |
| 4,197,510 | 4/1980 | Szu | 313/62 X |

FOREIGN PATENT DOCUMENTS

| | | | |
|---|---|---|---|
| 2254174 | 7/1975 | France | 328/234 |

OTHER PUBLICATIONS

IEEE Transactions on Nuclear Science, vol. NS-16, No. 3, part I, Jun. 1969, New York (US), M. K. Craddock et al.: "Magnetic Field . . . ."

*Primary Examiner*—David K. Moore
*Assistant Examiner*—K. Wieder
*Attorney, Agent, or Firm*—Roland Plottel

[57] ABSTRACT

Cyclotron permitting a better utilization of the power when an internal target is used. According to the invention, vertical defocussing coils are arranged along a circular path across which is arranged the target. The elongated, curved coils have the effect of destroying the vertical focusing and consequently widen the beam before impact takes place with the target, so that the latter is not damaged. Application to the production of radioisotopes.

7 Claims, 3 Drawing Figures

CYCLOTRON WITH FOCUSSING-DEFOCUSSING SYSTEM

BACKGROUND OF THE INVENTION

The present invention relates to a cyclotron with a focussing-defocussing system making it possible to significantly increase the admissible power level, when the target is placed within the accelerating structure.

An isochronous cyclotron is a charged particle (generally proton) accelerator, which comprises an electromagnet incorporating two pole pieces occupying the two axial faces, i.e. perpendicular to the axis, of a relatively flat, cylindrical accelerating cavity. A charged particle source is arranged in the centre of the cavity, in such a way that the magnetic field perpendicular to the path of the particle beam gives the latter a circular path. A conventional acceleration system has two flat electrodes, each of which is constituted by two disk portion-shaped parallel plates. These electrodes are raised to a high alternating voltage making it possible to apply four successive accelerations per revolution to the particles. Under these conditions, the energy of the particles increases and the path of the beam is now a divergent spiral and not a circle bringing the particles up to the periphery of the accelerating cavity. In the case when it is wished to extract the beam from the accelerating cavity (e.g. for bombarding a target so as produce a radioactive isotope), use is made of a curved electrostatic channel raised to a high voltage for the purpose of removing the beam from the attraction of the magnetic field and to tangentially extract it from the cavity. This is one of the most exposed members of the cyclotron and it must be particularly carefully positioned relative to the incident beam, in order to have the best possible extraction efficiency and also for ensuring that it is not bonbarded by an excessive fraction of the incident beam. This requires a very great fineness of the beam, or in other words a good focussing in all directions. The beam is characterized by its horizontal or radial focussing in the plane of the spiral and by its vertical focussing in the direction perpendicular to the pole pieces. It is known that the horizontal focussing can be obtained by increasing the value of the magnetic field as a function of the radius. This field gradient in the cavity also makes it possible to compensate the effect of increasing the particle mass during its acceleration (relativistic effect). However, this gradient is prejudicial to the vertical focussing. This problem has been solved by subjecting the particle, during each revolution, to an alternate succession of strong fields and weak fields. This is obtained by means of pole pieces having a series of thick, spaced sectors, which are circumferentially distributed in order to define in the cavity an alternating succession of wide air gap zones and narrow air gap zones. Under certain conditions, this arrangement ensures the vertical focussing. The power of the extracted beam is defined by the extraction efficiency, which largely depends on the heat dissipation limits of the aforementioned electrostatic extraction channel and more particularly a fine copper strip thereof, which is known as the septum.

However, numerous cyclotron users, particularly for producing certain radioisotopes, wish to obtain the most powerful beam possible. It has then been proposed to place the target within the accelerating cavity, substantially at the same distance from the centre as the electrostatic extraction channel, the latter being provisionally removed from the cavity. In this new cyclotron utilization mode, the pronounced focussing of the beam necessary for the extraction becomes a disadvantage, because the target cannot provide heat dissipation for such a localized impact zone and there is consequently a risk of it being damaged. Therefore the power of the beam must be limited in this internal target utilization mode and it is not possible to use the cyclotron at its nominal power, so that the power gain is below that which could have been expected when used with an internal target.

BRIEF SUMMARY OF THE INVENTION

The invention aims at solving this problem and its basic principle consists of locally acting on the aforementioned vertical focussing.

Thus, the present invention more specifically relates to a cyclotron having two pole pieces occupying the two axial faces of a relatively flat, cylindrical accelerating cavity, in the center of which is placed a charged particle source and which has means for positioning a target within said cavity, of the type in which the pole pieces have a succession of thick, spaced sectors regularly circumferentially distributed in order to define within the cavity an alternating succession of narrow air gap zones and wide air gap zones in order to ensure the vertical focusing, wherein there is also an arrangement of elongated coils arranged in a circular manner in the vicinity of the periphery of the cavity and means for supplying electric power thereto, in order to vary the vertical focussing conditions in the vicinity of a circular path corresponding to the radial positioning of the target.

BRIEF DESCRIPTION OF THE DRAWINGS

The invention will be better understood and further advantages thereof will be made apparent from the following description of two possible embodiments of a cyclotron according to the invention, given in an exemplified manner and with reference to the attached drawings, wherein show.

DETAILED DESCRIPTION OF THE PREFERRED EMBODIMENTS

Figure 1:
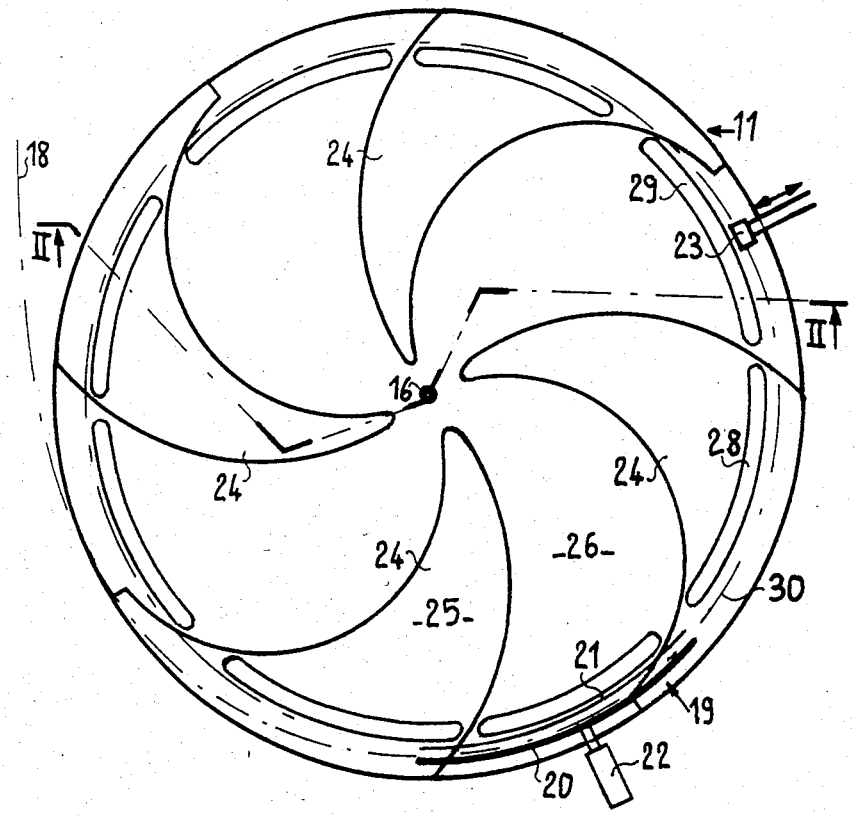
FIG. 1 a diagrammatic plan view of the essential parts of a cyclotron according to the invention.
Figure 2:
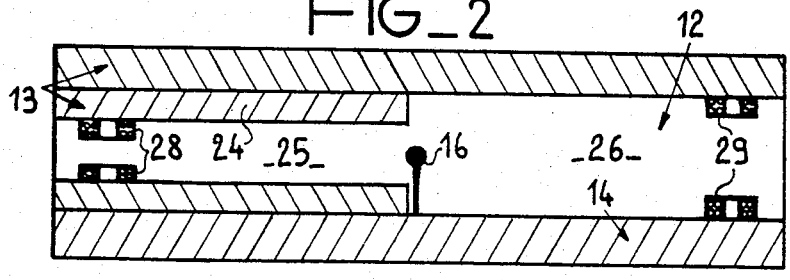
FIG. 2 a section II—II of FIG. 1.

In FIGS. 1 and 2, the main part of the cyclotron 11 comprises means for generating a powerful magnetic field in a relatively flat, cylindrical accelerating cavity 12. These means consist of a not shown, outer metal frame and two not shown coils supplied with direct current and positioned in the vicinity of the two spaced pole pieces 13, 14, which face one another in order to define an air gap. As the two pole pieces occupy the two axial faces of cavity 12, the latter coincides with the air gap. In operation, a vacuum is produced in cavity 12. In addition, the latter protects the accelerating electrodes, which are not shown in the drawing for reasons of clarity, but whose construction in the form of two disk portion-like parallel plates is well known to the skilled man. As stated hereinbefore, the particle source 16 is placed in the center of cavity 12. When it is wished to tangentially extract the beam (cf. trajectory 18 in FIG. 1) a curved, electrostatic extraction channel 19 is placed on the peripheral portion of cavity 12. The latter is constituted by the curved electrode 20 raised to a high d.c. voltage and a parallel electrode 21 at earth potential. This electrode, called a septum, must be very effectively cooled by conduction by means of copper blocks, which are in thermal contact therewith. The assembly is mounted on a radially movable support, diagrammatically indicated by a jack 22, in order to be able to remove the extraction channel from cavity 12 and place there a target 23 at another location, but at substantially the same radial distance with respect to source 16. As mentioned hereinbefore, the height of the air gap is not circumferentially constant, due to the presence of four thick sectors 24 on each pole piece 13, 14, which are spaced and regularly circumferentially distributed in order to define in cavity 12 an alternative succession of narrow air gap zones 25 and wide air gap zones 26. For this purpose, the sectors 24 respectively belonging to poles 13 and 14 are arranged in facing pairs, so as to be exactly superimposed in the axial direction of cavity 12. The charged particles, revolving in the plane of FIG. 1, thus successively encounter weak fields (wide air gap) and strong fields (narrow air gap), which is the requirement for a good vertical focussing. In known manner, the edges of the sectors are spiral and the particles revolve in clockwise direction in FIG. 1, i.e. so as to encounter a concave transition profile between two adjacent zones 25 and 26.

According to an essential aspect of the invention, the cyclotron also has an arrangement of elongated coils 28, 29, arranged in circular manner in the vicinity of the periphery of cavity 12, as well as means for supplying electricity to the said coils (not shown because said means only consist of one or more direct current sources), in order to vary the vertical focusing conditions in the vicinity of a circular path 30 corresponding to the radial position of target 23. In the present case, circular path 30 corresponds to the extraction radii (i.e. the radial distance at which the electrostatic channel 19 is positioned), said path being that of the particles performing their final revolution in the cavity and having consequently reached a maximum energy. Coils 28 are arranged on sectors 24, i.e. in the narrow air gap zones and face one another in pairs. Moreover, the coils 29 are arranged in the wide air gap zones and also face one another in pairs. Each coil 28, 29 is constituted by several narrow turns, which are parallel to the pole pieces and these turns are curved so as to bring about maximum adaptation to the circular path 30. Each pole piece has a coil 28 or 29 for each narrow or wide air gap zone respectively. Coils 29 are connected to the supply means with a direction tending to locally strengthen the magnetic field in the wide air gap zones, whilst coils 28 are connected to the supply means with a direction tending to locally weaken the magnetic field in the narrow air gap zones.

The following mathematical development provides a better understanding of the action of this set of coils on the vertical focusing of the beam.

The vertical focussing effect obtained by the pole pieces defined hereinbefore is expressed by a coefficient $\nu z$ such that:

$$\nu z = \frac{N^2}{N^2 - 1} \frac{\epsilon^2}{2} (1 + tg^2\alpha) - k$$

$\nu z$ representing the number of focussing "nodes" of the beam per revolution (in practice e.g. $\nu z \simeq 0.4$ is sought) and in the above formula N is the number of sectors 24 (four in the present case), $\alpha$ is a coefficient linked with the geometry (spiralling) of the sectors, $$k = \frac{R}{B} \frac{dB}{dR}$$

characterizes the horizontal focussing gradient, R being the radius of a considered orbit and B the value of the magnetic field in the vicinity of said radius, whilst $$\frac{\epsilon 2}{2} = \frac{<B^2> - <B>^2}{<B>^2}$$

represents a type of root-mean-square of magnetic field variation on a given orbit.

In order that the vertical focusing is effective, it is necessary for $\nu z$ to be positive, a negative $\nu z$ value physically signifying a defocussing, i.e. a widening of the beam. This is what is brought about by the invention by reducing the root-mean-square $$\frac{\epsilon 2}{2}$$

because it is not possible to modify either the number of sectors, or their shape, or the horizontal focussing. This defocussing must take place during the time the particles define the final revolutions preceding the aforementioned circular path 30 and this is why coils 28 and 29 are arranged so as to be substantially tangential within a fictitious cylindrical surface passing through said circular path 30.

In practice, several connection types are possible. For example, all the coils can be connected (e.g. in series) to a single adjustable electric power supply, the winding direction of the coils 29 in the wide air gap zones being the opposite of the winding direction of the coils 28 in the narrow air gap zones. Particularly, but not exclusively in this case, the number of ampere turns of the coils 29 in the wide air gap zones is larger than the number of ampere turns of the coils 28 in the narrow air gap zones, because the magnetic field correction in these zones must be carried out over a smaller air gap distance.

It is also possible to connect all the coils 29 in the wide air gap zones to a first adjustable electric power supply, whilst all the coils 28 in the narrow air gap zones are connected to a second adjustable electric power supply with the reverse connection direction. Although this variant involves an additional supply source, its use is more flexible in that independent regulation of the field corrections in zones 25 and 26 is possible.

Figure 3:
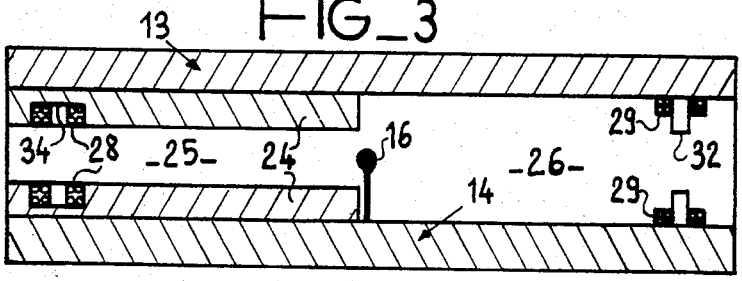
FIG. 3 a view identical to FIG. 2 illustrating another embodiment of the invention.

FIG. 3 illustrates another embodiment in which the wide air gap zones 26 are provided with projecting circular portions or shims 32, which locally reduce the air gap in the vicinity of the circular path 30 and/or the narrow air gap zones are provided with slots 34 locally increasing the air gap in the vicinity of said same path. Under these conditions, the dimensional characteristics of the parts are modified in order to place the cyclotron at the lower limit of a correct vertical focussing and it is merely necessary to place polarity reversal means between coils 28, 29 and the corresponding supply means in order that the fields developed by said coils in one case increase the root-mean-square $\epsilon 2/2$ and consequently increase the focussing in order to permit a correct extraction of the beam and in the other case reduce the said root-mean-square to ensure the vertical defocussing and so as to permit operation with an internal target. In the case of this embodiment, the electric power consumed by coils 28, 29 is approximately half that necessary with the preceding embodiment. Moreover, the slots 34 can be utilized for the integration of coils into the narrow air gap zones, where there is least space for the housing thereof.

Obviously the invention is not limited to the embodiments described hereinbefore and in fact covers all technical equivalents of the means used without passing beyond the scope of the invention.

What is claimed is:

1. A cyclotron having two pole pieces occupying the two axial faces of a relatively flat, cylindrical accelerating cavity, in the center of which is placed a charged particle source and which has means for positioning a target within said cavity, of the type in which the pole pieces have a succession of thick, spaced sectors regularly circumferentially distributed in order to define within the cavity an alternating succession of narrow air gap zones and wide air gap zones in order to ensure the vertical focussing, wherein there is also an arrangement of elongated narrow curved arcuate coils arranged in a circular manner in the vicinity of the periphery of the cavity and means for supplying electric power thereto, in order to vary to defocus the vertical focussing conditions in the vicinity of a circular path corresponding to the radial positioning of the target the coils locally strengthening the fields in the wide air gap regions and locally weakening the field in the narrow air gap regions.

2. A cyclotron according to claim 1, wherein each pole piece has one coil for narrow and wide air gap zone, respectively.

3. A cyclotron according to claim 2, wherein the coils located in a wide air gap zone are connected to the power supply means in a direction tending to locally strengthen the magnetic field in said zone and wherein the coils located in a narrow air gap zone are connected to said power supply means with a direction tending to locally weaken the magnetic field in said zone.

4. A cyclotron according to claim 3, wherein all the coils are connected to a single adjustable electric power supply, the winding direction of the coils located in the wide air gap zones being the opposite to that of the winding direction of the coils located in the narrow air gap zones.

5. A cyclotron according to claim 3, wherein all the coils located in the wide air gap zones are connected to a first adjustable electric power supply, whilst all the coils located in the narrow air gap zones are connected to a second adjustable electric power supply.

6. A cyclotron according to claim 4; wherein the number of ampere turns of the coils located in the wide air gap zones exceeds the number of ampere turns of the coils located in the narrow air gap zones.

7. A cyclotron according to claim 1; wherein the wide air gap zones are provided with projecting circular portions locally reducing the air gap in the vicinity of the aforementioned circular path and the narrow air gap zones are provided with slots locally increasing the air gap in the vicinity of the same circular path.

* * * * *